US005535535A

United States Patent [19]

DuFour

[11] Patent Number: 5,535,535

[45] Date of Patent: Jul. 16, 1996

[54] FABRIC SPREADER FOR FABRIC CUTTING MACHINE

[76] Inventor: Darlene DuFour, 178 Moss Ridge, Pineville, La. 71360

[21] Appl. No.: 416,301

[22] Filed: Apr. 4, 1995

[51] Int. Cl.[6] ..... D06C 05/00

[52] U.S. Cl. ..... 38/143; 26/83; 83/939

[58] Field of Search ..... 38/143, 1 R, 69, 38/102, 102.21; 26/80, 83, 84, 85; 83/425.4, 940, 96, 901, 939

[56] References Cited

U.S. PATENT DOCUMENTS

| | | | |
|---|---|---|---|
| 1,659,380 | 2/1928 | Spiegel | 26/80 |
| 2,339,151 | 1/1944 | Cohn et al. | 26/83 |
| 2,634,488 | 4/1953 | Cohn et al. | 26/84 |
| 3,479,706 | 11/1969 | Catallo | 26/83 |
| 3,916,492 | 11/1975 | Coates | 26/84 |

FOREIGN PATENT DOCUMENTS

| | | | |
|---|---|---|---|
| 2748026 | 6/1978 | Germany | 83/901 |

*Primary Examiner*—Ismael Izaguirre
*Attorney, Agent, or Firm*—Rodney Bryant Jordan

[57] ABSTRACT

An apparatus for use with fabric measuring and cutting machines for the purpose of assuring that tubular fabric that is drawn from storage is forced into an essentially flat, wrinkle free form prior to its entry into the measuring and cutting machine. The apparatus consists of a rectangular frame which is adjustable in width and is required to sit in a clamped position atop the feed rollers of the measuring and cutting machine so that the tubular fabric in forced over the device just prior to its being pulled into the cutting and measuring device.

5 Claims, 3 Drawing Sheets

FABRIC SPREADER FOR FABRIC CUTTING MACHINE

BACKGROUND OF THE INVENTION

The invention as described herein comprises an apparatus for use as an attachment for fabric cutting machines. Many articles of clothing, such as "T" shirts are made from fabric which is woven and formed in a tube shape. For shipping and storage this material is folded onto shipping pallets just as any other fabric. In order to be used this fabric must be cut into very accurate pattern pieces. For the sake of efficiency, most cutting machines are set up to cut several layers of fabric simultaneously. In order to accomplish this, the material must be pulled from its place of storage and maneuvered into uniform, wrinkle-free layers. The fabric must be fed into the system at the proper rate of speed. This is accomplished by a fabric measuring mechanisms. These mechanisms pull fabric into the system at a controlled speed. In order to be cut evenly, due to the fact that the fabric is in the form of a tube, an apparatus is required to spread the fabric out to the needed width as it is drawn through the measuring mechanism and fed into the cutting machine. It is this purpose that is fulfilled by this invention.

DESCRIPTION OF THE PRIOR ART

Previously, fabric cutting machines have been equipped with various clumsy, fragile and ineffective devices for the spreading of fabric prior to measuring. These designs twisted and collapsed under the stress of high speed cutting, were difficult to adjust for various widths of fabric, and failed to uniformly spread the cloth. This resulted in wrinkled fabric which caused inaccurate measuring and excessive down time. The demand for the products that these cutting machines are producing and the extreme expense of the cutting machinery requires that a more suitable design be employed. The invention as described herein utilizes such a design.

SUMMARY OF THE INVENTION

The fabric spreader consists primarily of a rectangular metal frame that is adjustable in width and equipped with a mechanism by which it rests above the rollers of the fabric measuring mechanism of a fabric cutting machine. Many fabric cutting machines have several measuring mechanisms in order to allow several layers of fabric to be cut by a single cutting die at once and therefore require more than one fabric spreader. The width of the spreader is adjusted so that the tube of fabric which is drawn over it will be forced into an essentially flat sheet. The fabric is drawn from metal racks which are mounted above the measuring devices. The fabric spreader rests atop the measuring mechanism, above the rollers, as fabric is drawn over and across the spreader. This allows the fabric to be drawn through the measuring mechanisms in flat layers, each layer entering the system at the proper speed. The material is then cut into pattern pieces evenly and accurately due to the material being essentially in a flat, wrinkle-free sheet when it reaches the cutter.

BRIEF DESCRIPTION OF THE DRAWINGS

Figure one is a front elevation view of the fabric spreader.

Figure two is a front elevation view of the fabric spreader mounted to a fabric cutter measuring mechanism.

Figure 1:
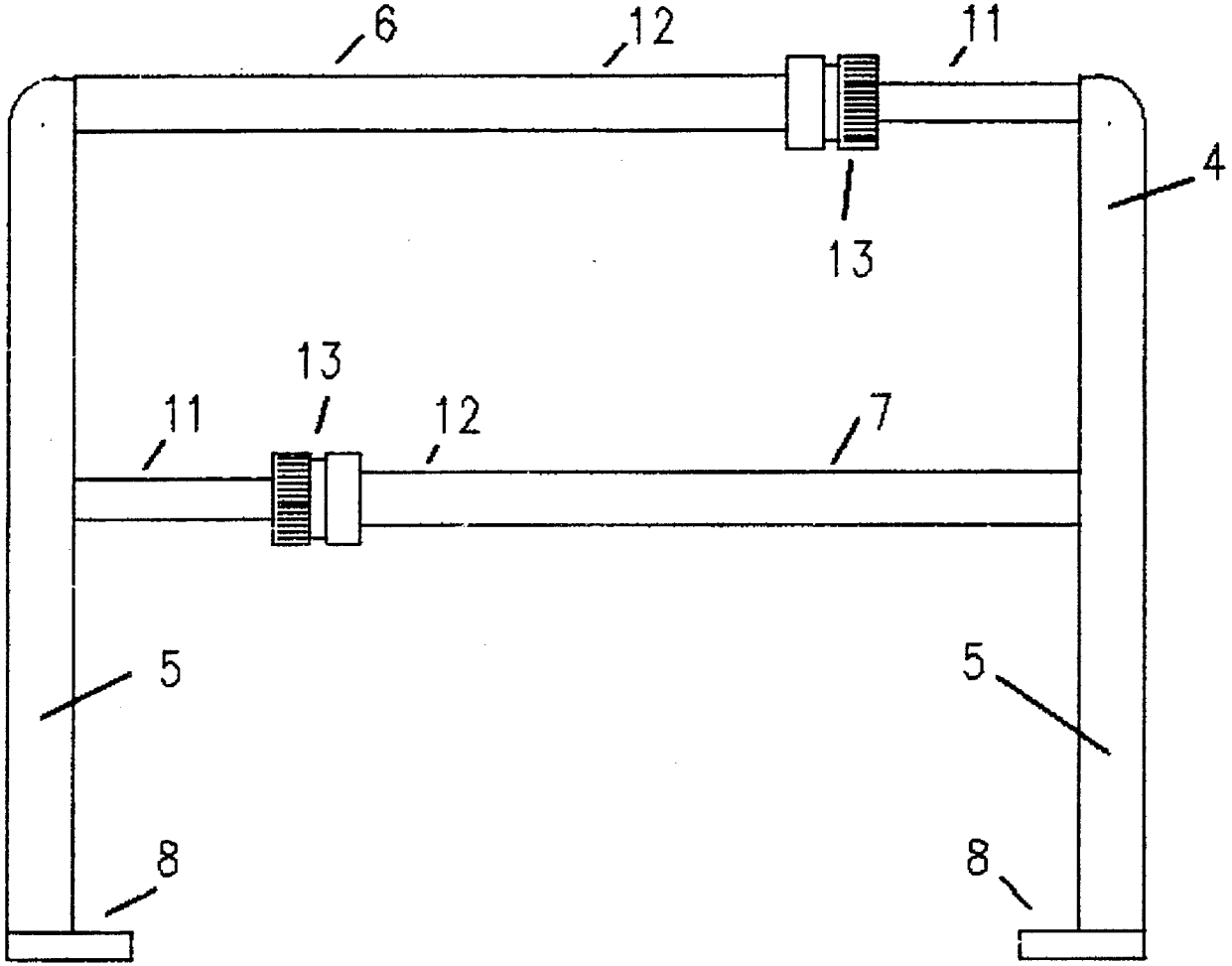
Figure 2:
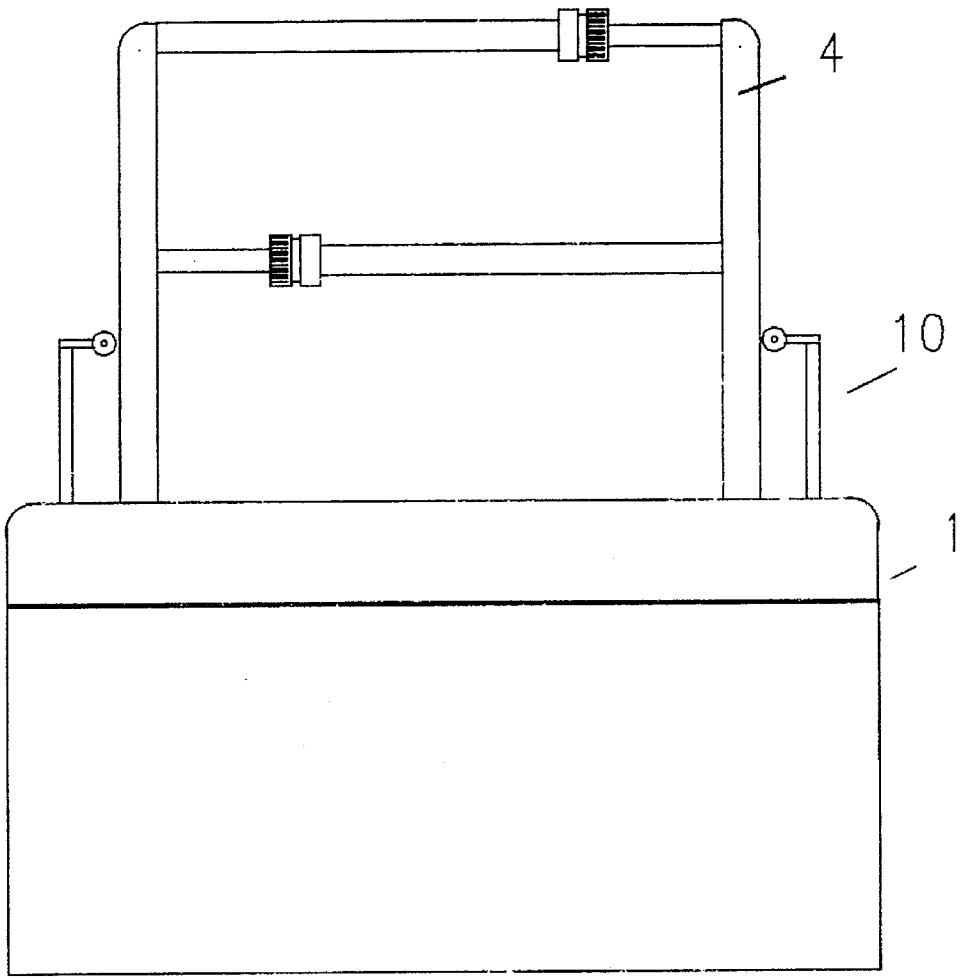
Figure 3:
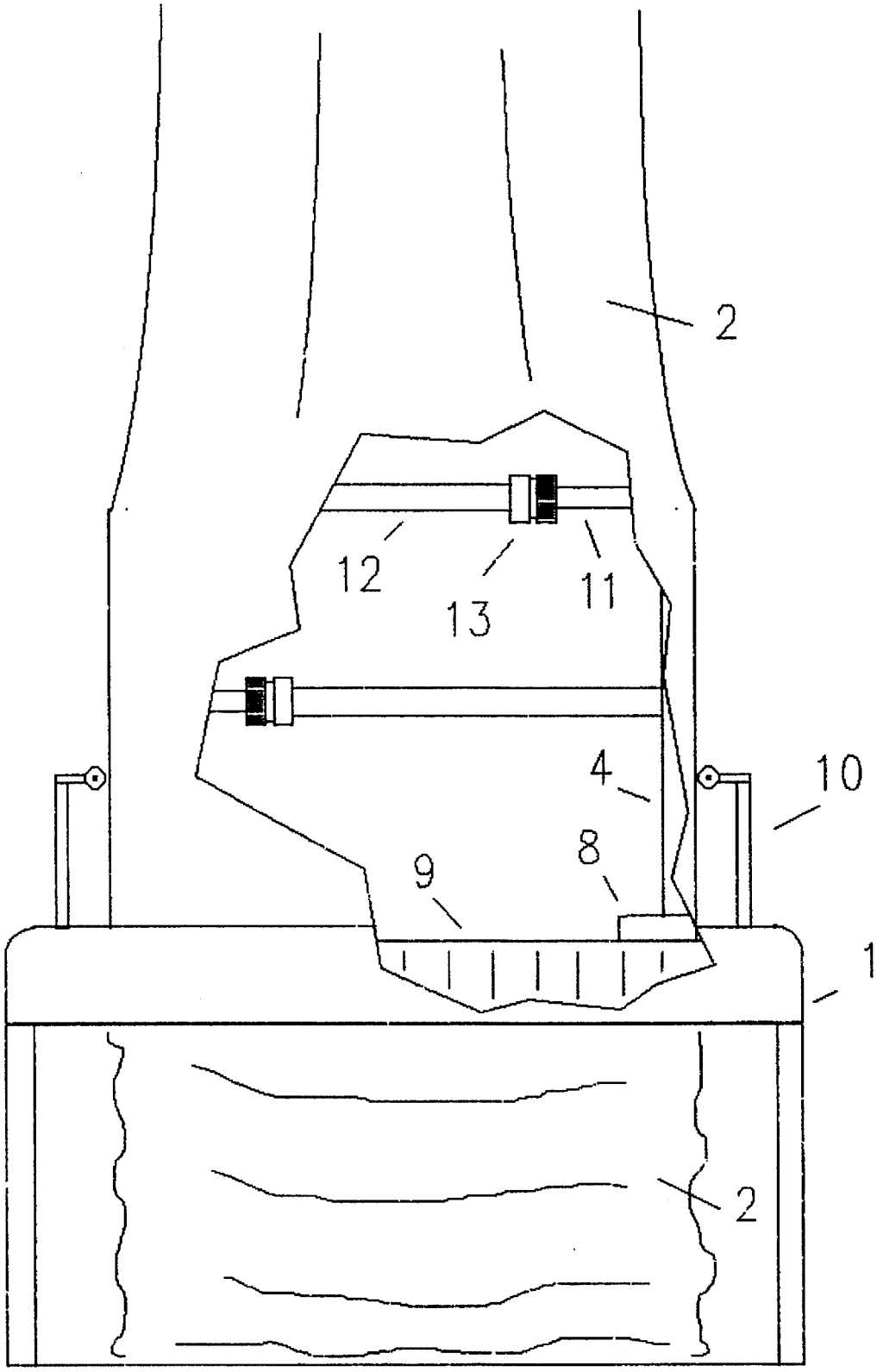

Figure three is a cut away view of fabric being drawn through the fabric cutter measuring mechanism.

DETAILED DESCRIPTION

Referring to the figures it can be seen that the fabric cutter measuring mechanism 1 consists of a machine in which a continuous length of fabric 2 is pulled from above the machine. The fabric 2 is cut to specific pattern parts by a cutter die located within the cutter section of the machine as the fabric 2 is pulled through the fabric measuring mechanism 1 and fed into the cutter. The fabric spreader 4 is mounted above the fabric cutter measuring mechanism 1. The fabric 2, being tubular, engulfs the fabric spreader 4 as it is pulled into the fabric cutter measuring mechanism 1. The fabric spreader 4 is so positioned on the fabric cutter measuring mechanism 1 that the tubular fabric 2 will be forced to its widest and therefore flattest dimension, thus allowing for accurate measuring of the fabric prior to its being sent to the cutter section. This allows a controlled feed so that several layers of fabric may be sent to the cutter section at the proper speed and ratio.

Referring more specifically to figure one, it can be seen that the fabric spreader 4 comprises two side flanges 5, a top cross bar 6, and a mid cross bar 7. Side flanges 5 are equipped with mounting pins 8 at their lower ends. Fabric spreader 4 rests atop the convergence of rollers 9 of fabric cutter measuring mechanism 1 on mounting pins 8. The fabric spreader is held in a vertical position by clamping means 10. The rotation of rollers 9 pulls the fabric into the machine at the proper speed. Each cross bar 5 and 6 further comprises a telescoping tube arrangement consisting of a solid inner rod 11 which slides into an outer tube 12. Outer tube 12 is constructed of a solid rod which is bored to accept inner rod 11. This provides for maximum strength. The length of crossbars 5 and 6 are determined by sliding inner rods 11 into outer tubes 12. The width adjustment is secured by screw compression fasteners 13. These fasteners are positioned on opposite ends of the two crossbars in order to add strength to the design. Inner rods 11 are calibrated in order to facilitate setting the width of the fabric spreader. Flanges 5 are spread to the desired width, depending upon the width fabric tube being measured, by telescoping top cross bar 6 and mid cross bar 7 to the desired length and securing with compression fasteners 13.

The utilizing of the invention described herein assures that the fabric that is being cut into precise patterns is held in a smooth, flat sheet. This allows for faster, better cutting of material for the manufacture of garments.

I claim:

1. An apparatus for use as an attachment to the fabric measuring mechanisms of fabric measuring and cutting machines for the purpose of spreading tubular lengths of fabric into flat, wrinkle free sheets prior to said fabric's entry into said measuring mechanism of said measuring and cutting machine said apparatus having a means for spreading said fabric, said means comprising an essentially rectangular frame, said frame further comprising two sides, a top and a mid section, said frame further comprising two side flanges, one said flange being positioned vertically at, and forming each said side of said rectangular frame, each said side flange having a mid section and a top and bottom end, said frame further comprising a top cross bar, said top cross bar having a left and right end, said ends being affixed to said top ends of said side flanges, said rectangular frame further comprising a mid cross bar having a left and right end, said ends of said mid cross bar being affixed to said mid sections of said side flanges, said bottom ends of said side flanges extending significantly below said mid cross bar, said rectangular frame being open between said bottom ends of said side flanges, said fabric being drawn over and around said rectangular frame so that said fabric is forced to its maximum, wrinkle free width by said side flanges, said apparatus also having a means for mounting said apparatus to said measuring and cutting machine, a means for adjusting said rectangular frame to different dimensions of said tubular fabric, and a means for determining said setting of said dimensions of said rectangular frame, said measuring mechanisms further comprise a set of horizontally positioned, converging feed rollers through which said fabric is pulled, said apparatus being so constructed, wherein said means for mounting said apparatus to said measuring and cutting machine comprises two support pins, said support pins being affixed to said bottom ends of said side flanges in a vertical position, in the same plane with said top crossbar and said mid cross bar, said support pins being tubular in shape, said support pins having an outer and inner end, said inner ends being tapered so as not to catch said fabric as said fabric is pulled across said support pins by said feed rollers, said apparatus being held in an upright position by a clamping member, said clamping member extending above said measuring mechanism, and by said support pins, said support pins resting upon the convergence of said feed rollers.

2. An apparatus as recited in claim 1, wherein said means for adjusting said rectangular frame comprises changing the length of said top cross bar and said mid cross bar simultaneously, said top cross bar and said mid cross bar further comprising a telescoping tube arrangement, wherein said cross bars further comprise an inner rod, an outer tube, said outer tube having an inward end and an outward end, said outward ends being affixed to said side flanges, and a screw compression fastener positioned at each inward end of each outer tube, said inner rod being sized to slide into said outer tube to the desired degree, said adjustment being acquired by sliding said inner rods into said outer tubes to the desired position and tightening said screw compression fasteners.

3. An apparatus as recited in claim 2, said means for determining said setting of said dimension of said rectangular frame comprises calibration markings, said calibration markings being imprinted upon said inner rod of said top cross bar and said mid cross bar.

4. An apparatus as recited in claim 3, wherein said outer tubes are constructed of solid rods bored to accept said inner rods.

5. An apparatus as recited in claim 4, wherein said outward end of said outer tube of said top cross bar is affixed to said side flange on one said side of said rectangular frame and said outward end of said outer tube of said mid cross bar is affixed to said side flange on the opposite said side of said rectangular frame so that said screw compression fasteners are positioned at opposite sides, thus adding strength to said rectangular frame.

* * * * *